US008011221B2

(12) United States Patent
Hong et al.

(10) Patent No.: US 8,011,221 B2
(45) Date of Patent: Sep. 6, 2011

(54) APPARATUS FOR MACHINING VARIABLE TRIM LINE OF PANEL

(75) Inventors: Deok Pyo Hong, Gyeonggi-do (KR); Hee Ra Lim, Gyeonggi-do (KR)

(73) Assignee: Kia Motors Corporation, Seoul (KR)

( * ) Notice: Subject to any disclaimer, the term of this patent is extended or adjusted under 35 U.S.C. 154(b) by 448 days.

(21) Appl. No.: 12/217,397

(22) Filed: Jul. 5, 2008

(65) Prior Publication Data

US 2009/0151417 A1 Jun. 18, 2009

(30) Foreign Application Priority Data

Dec. 13, 2007 (KR) ..... 10-2007-0129586

(51) Int. Cl.
*B26F 1/04* (2006.01)
*B21D 17/02* (2006.01)
*B26D 5/02* (2006.01)

(52) U.S. Cl. ..... 72/441; 72/384; 83/549; 83/563; 83/733

(58) Field of Classification Search ..... 72/441, 72/442, 384; 83/549, 563, 571, 733
See application file for complete search history.

(56) References Cited

U.S. PATENT DOCUMENTS 4,480,782 A * 11/1984 Morishima ..... 83/571
4,509,357 A * 4/1985 Zbornik ..... 72/384
5,144,872 A 9/1992 Kakimoto
5,881,625 A * 3/1999 Wellman ..... 83/563
6,481,323 B1 * 11/2002 Beerhalter ..... 83/563
6,619,542 B2 * 9/2003 Beerhalter ..... 83/563
6,769,600 B1 * 8/2004 Knox et al. ..... 83/733
7,086,582 B2 * 8/2006 Yang et al. ..... 83/549

FOREIGN PATENT DOCUMENTS

JP 60-148630 8/1985
JP 63-123538 5/1988
KR 10-1997-0025759 6/1997

* cited by examiner

*Primary Examiner* — David B Jones

(74) *Attorney, Agent, or Firm* — Edwards Angell Palmer & Dodge LLP; Peter F. Corless

(57) ABSTRACT

The present invention relates to an apparatus for machining a variable trim line of a panel, which can machine the variable trim line through a simple manipulation within a single process at the time of machining a trunk lid panel. The apparatus includes: an upper die unit disposed at an upper die steel and including a select retainer adapted to selectively punch the variable trim line of the panel, and an upper punch adapted to be moved forward and backward; and a lower die unit disposed at a lower die steel in such a fashion as to be directed opposite to the upper die unit in a row and adapted to push a strap caught in the lower die steel while cooperating with punching operation of the upper punch of the upper die unit. With the apparatus, a die manufacturing cost can be reduced, productivity can be increased and default rate can be reduced.

3 Claims, 8 Drawing Sheets

[DETAIL OF A PART]: NON-MOUNTED PIC

[DETAIL OF A PART]: MOUNTED PIC

APPARATUS FOR MACHINING VARIABLE TRIM LINE OF PANEL

CROSS-REFERENCE TO RELATED APPLICATION

This application claims the benefit under 35 U.S.C. §119 (a) of Korean Patent Application No. 10-2007-0129586 filed on Dec. 13, 2007, the entire contents of which are incorporated herein by reference.

BACKGROUND (a) Technical Field

The present invention relates to an apparatus for machining a variable trim line of a panel for a vehicle. More particularly, the present invention relates to an apparatus for machining a variable trim line of a panel for a vehicle, which can machine the variable trim line through a simple manipulation within a single process at the time of machining a trunk lid panel.

(b) Background Art

A general smart key is used like an ignition key or a remote controller when a user opens or closes a door of a vehicle as shown in FIG. 1. In case of a smart key system 10 mounted on a vehicle, the system permits a door locking device to be released and the engine to start automatically when a user approaches his or her vehicle although a person holding a smart key does not insert the smart key into a key hole of his or her vehicle's door, and permits the vehicle's door to be locked automatically when the smart key holding person goes away from the vehicle. This is also called a personal identification card (PIC).

In FIG. 1, reference numeral 11 denotes a trunk lid outer panel, reference numeral 12 denotes a trunk lid inner panel, and reference numeral 13 denotes a trunk lid outer lower panel.

FIG. 2 is a schematic view showing a trunk lid outer upper panel 14 of a passenger vehicle.

The trunk lid outer upper panel 14 is mounted with the smart key system (PIC) as an option. Importantly, a trim line of a product varies as shown by a dotted line of FIG. 2 when the smart key system is mounted or not mounted on the trunk lid outer upper panel 14. Accordingly, this trim line is called herein a variable trim line.

Conventionally, in the case of an MG-type car, five die sets, for example, OP 10(DRAW), OP 20(TRIM)-PIC not mounted, OP 30(TRIM)-PIC mounted, OP 40(FL) and OP 50(C/FL) are set on five presses. A vehicle mounted with the PIC is produced in, e.g., the OP 30 process.

Also, for example, in the case of an NF-type car, four die sets, for example, OP 10(DRAW), OP 20(TRIM)-PIC not mounted, OP 30(FL) and OP 40(C/FL) are set on four presses. An additional OP 20(TRIM)-PIC mounted die is mounted on a preliminary bolster. A vehicle mounted with the PIC is produced through replacement of the bolster depending on a specification.

FIG. 3 is a schematic view showing a detailed structure of a die for use in both the OP 20 and the OP 30 processes of the MG-type car.

The sequence of machining a trunk lid panel will be described hereinafter.

When a panel is placed on a lower die steel 15 in the OP 20 process, an upper die pad (not shown) is lowered to securely grip the panel. Then, an upper die steel 16 is lowered to trim the panel, producing a trunk lid panel not mounted with a smart key. Subsequently, a selected punch 17 machines a variable trim line of the trunk lid panel not mounted with the smart key in the OP 30 process, producing a trunk lid panel which can be mounted with the smart key.

In FIG. 3, reference numeral 18 denotes a variable trim portion.

However, the prior art apparatuses have drawbacks. For instance, the manufacturing costs for dies are high. If one manufacturing company uses an apparatus of five die sets, and another company uses an apparatus of four die sets, there could be compatibility issues between the two apparatuses, thus making it difficult to produce a vehicle mounted with the PIC and/or increasing the production cost.

The information disclosed in this Background section is only for enhancement of understanding of the background of the invention and should not be taken as an acknowledgment or any form of suggestion that this information forms the prior art that is already known to a person skilled in that art.

SUMMARY OF THE DISCLOSURE

The present invention has been made in an effort to solve the above problems occurring in the prior art, and it is an object of the present invention to provide an apparatus for machining a variable trim line of a panel. That is, in the present invention, even when a trim line of a panel varies depending on a product specification, the variable trim line is machined in a single process.

In order to accomplish the above object, according to a preferred embodiment of the present invention, there is provided an apparatus for machining a variable trim line of a panel, the apparatus comprising: an upper die unit disposed at an upper die steel and including a select retainer to selectively punch the variable trim line of the panel, and an upper punch to be moved forward and backward; and a lower die unit disposed at a lower die steel in such a fashion as to be directed opposite to the upper die unit in a row and to push a scrap caught in the lower die steel while cooperating with the punching operation of the upper punch of the upper die unit.

Preferably, the lower die unit may comprise: a lower punch that is slidably moved forward and backward at a bottom of the lower die steel and acts as a corresponding counterpart of the upper punch at an opposite side to the upper punch upon the punching operation of the upper punch; a gas tank disposed at a rear end of the lower punch and to elastically support the lower punch and provide a forward restoring force to the lower punch upon the backward pushing of the lower punch; and a stopper to restrict a forward restoring position of the lower punch.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

The above and other features of the invention are discussed infra.

Figure 1:
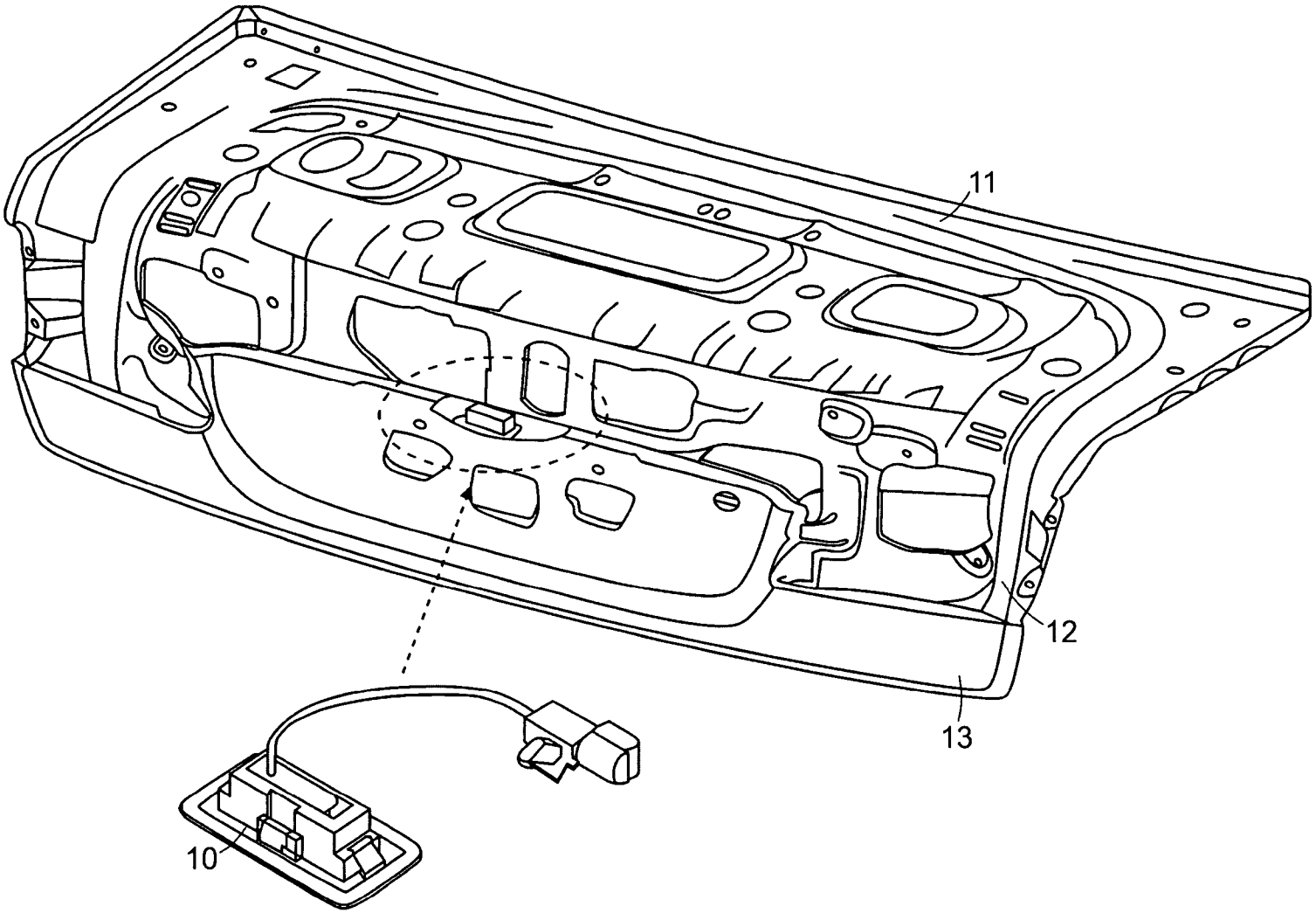
FIG. 1 is a perspective view showing a trunk lid panel and a smart key system of a vehicle.
Figure 2:
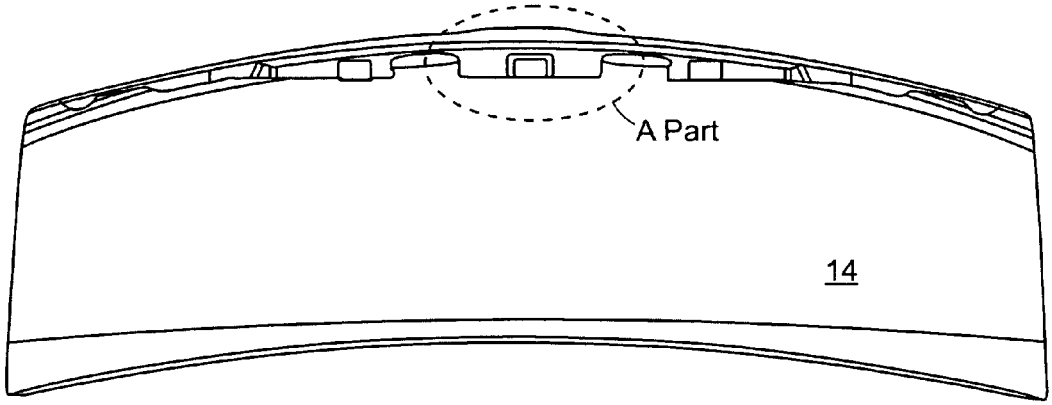
FIG. 2 is a schematic view showing a variable trim line of a trunk lid panel of a vehicle.
Figure 2:
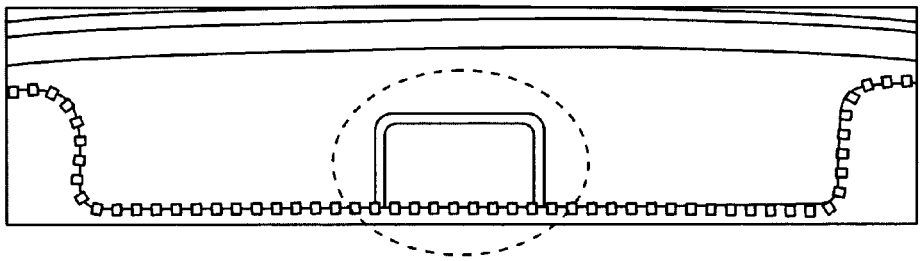
Figure 2:
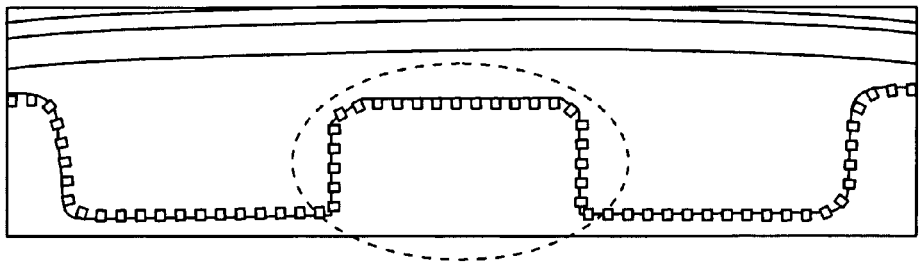
Figure 3:
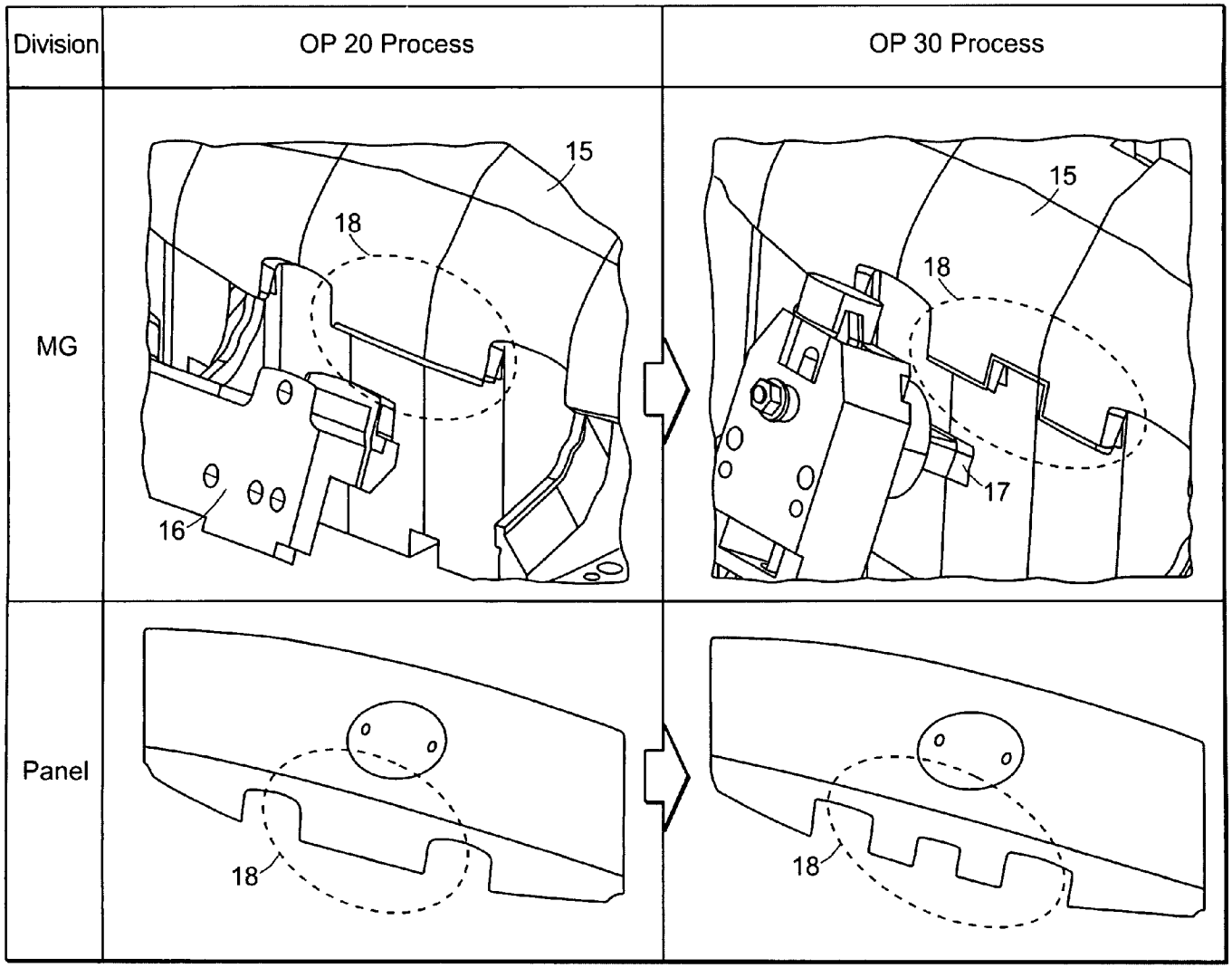
FIG. 3 is a schematic view showing a machining process of a trunk lid panel which is not mounted with a smart key system (PIC) and a trunk lid panel which is mounted with the smart key system (PIC)

Reference numerals set forth in the Drawings includes reference to the following elements as further discussed below:

| | |
|---|---|
| 10: smart key system | 11: trunk lid outer panel |
| 12: trunk lid inner panel | 13: trunk lid outer lower panel |
| 14: trunk lid outer upper panel | 15: lower die steel |
| 16: upper die steel | 17: selected punch |
| 18: variable trim portion | 19: select retainer |
| 20: upper punch | 21: upper die unit |
| 22: lower die unit | 23: lower punch |
| 24: gas tank | 25: stopper |
| 26: guide bush | 27: guide groove |

DETAILED DESCRIPTION

Reference will now be made in detail to the preferred embodiment of the present invention, examples of which are illustrated in the drawings attached hereinafter, wherein like reference numerals refer to like elements throughout. The embodiments are described below so as to explain the present invention by referring to the figures.

Apparatuses according to preferred embodiments of the present invention include an upper die unit and a lower die unit. The upper die unit includes an upper punch mounted at a select retainer. Specifically, based on a variation of trim for a panel, the upper punch is moved forward and backward to control the machining of the trim. The lower die unit includes a lower punch for trimming a panel, a guide bush for precisely guiding the forward and backward movement of the lower punch 23, and a gas tank for pushing the lower punch to eject a scrap.

The construction of the upper die unit and the lower die unit will be described hereinafter in more detail.

Figure 4:
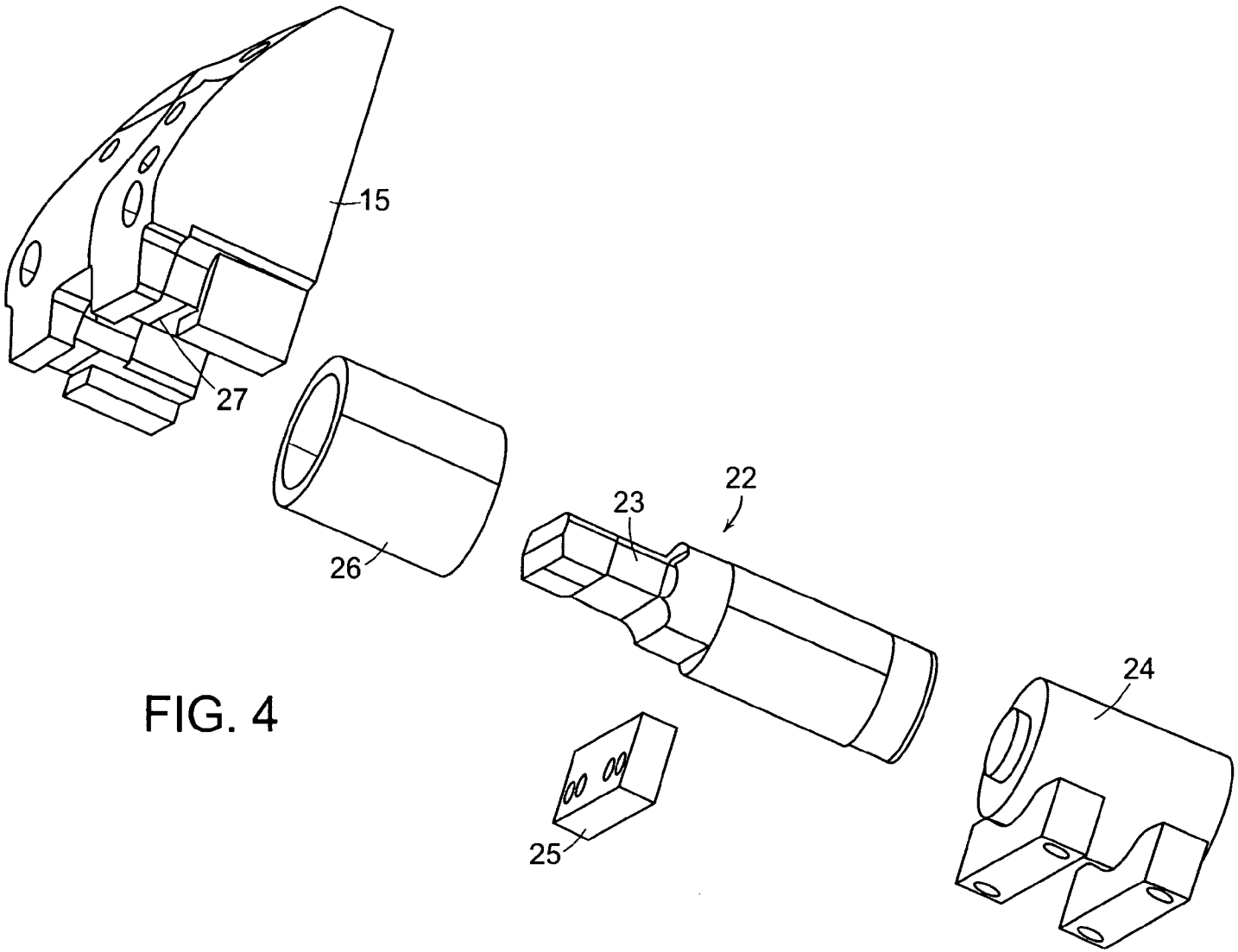
FIG. 4 is an exploded view showing a lower die unit in an apparatus for machining a variable trim line of a panel according to an embodiment of the present invention.
Figure 5:
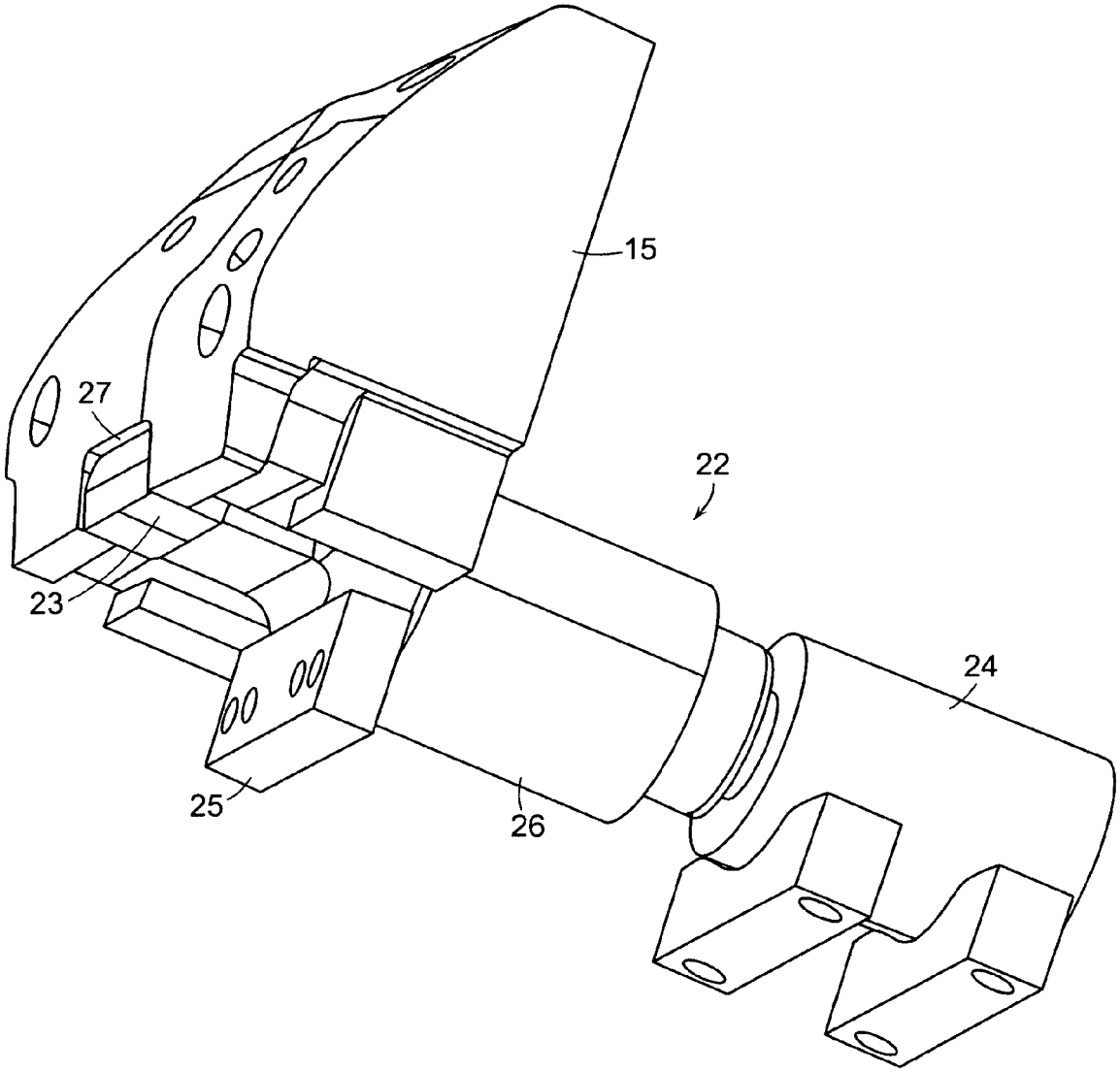
FIG. 5 is an assembled view showing the lower die unit in the apparatus for machining the variable trim line of the panel according to an embodiment of the present invention.
Figure 6:
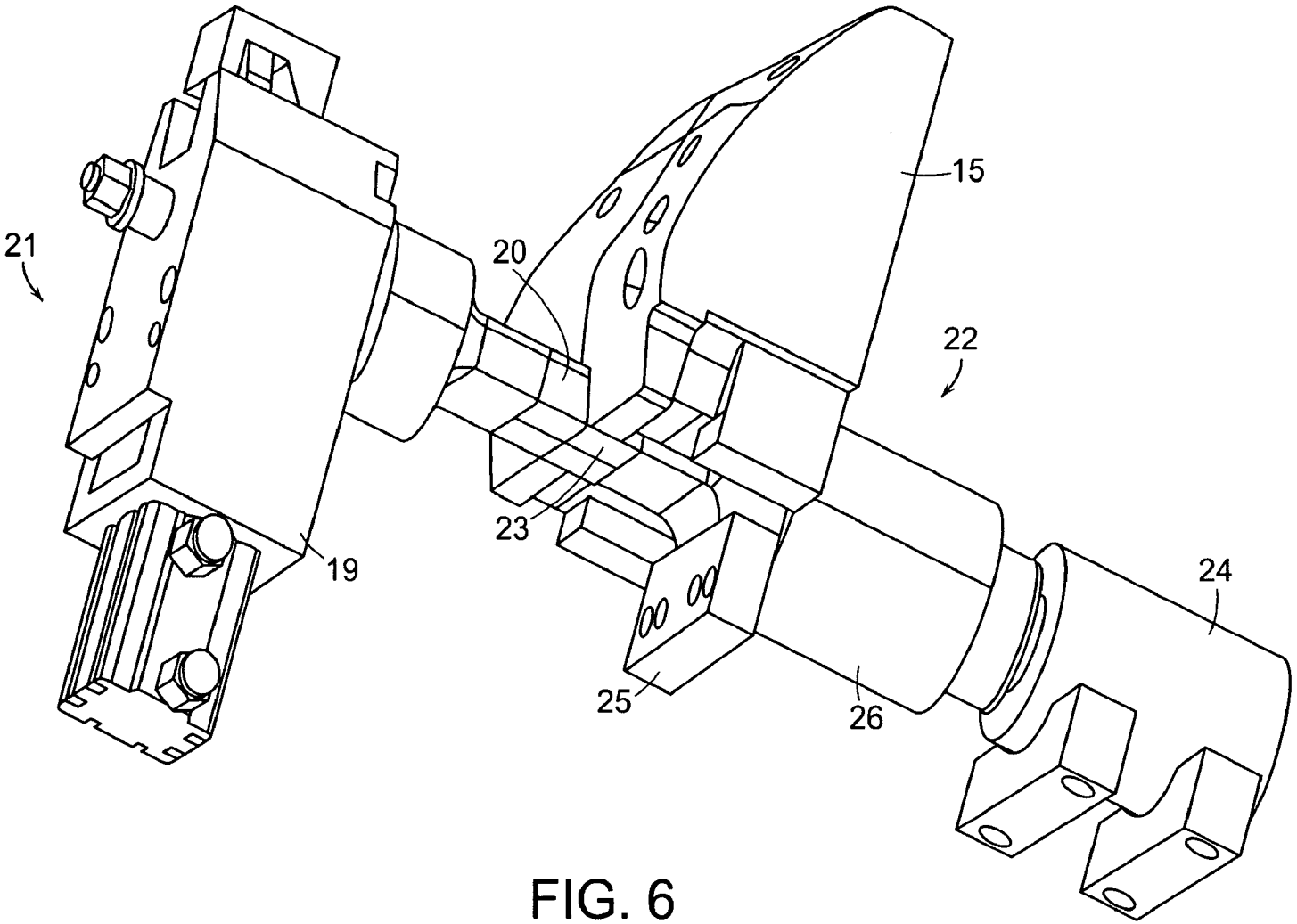
FIG. 6 is a perspective view showing the arrangement of the upper die unit and the lower die unit which are assembled to each other in the apparatus for machining the variable trim line of the panel according to an embodiment of the present invention.

FIGS. 4 and 5 are an exploded view and an assembled view showing a lower die unit in an apparatus for machining a variable trim line of a panel according to an embodiment of the present invention, and FIG. 6 is a perspective view showing the arrangement of the upper die unit and the lower die unit which are assembled to each other in the apparatus for machining the variable trim line of the panel according to an embodiment of the present invention.

As shown in FIGS. 4 to 6, an upper die unit 21 is mounted at an upper die steel 16 of a die for machining a panel, and a lower die unit 22 is mounted at a lower die steel 15.

The upper die unit 21 and the lower die unit 22 are arranged in such a fashion as to be directed toward each other in the same line.

The upper die unit 21 includes a select retainer 19 and an upper punch 20. The upper punch 20 is movable forward and backward depending on the operation of the select retainer 19. In this case, the upper punch 20 is in a forward position when a variable trim portion is machined, and is a backward position when the variable trim portion is not machined, as will be detailed below.

At this time, the operation of the select retainer 19 can be performed under the control of a controller (not shown) associated with a die side of the system.

The lower die unit 22 includes a lower punch 23 and a gas tank 24. The lower punch 23 is assembled into the lower die steel so it can be slidably moved within a guided groove 27 formed on a bottom surface of the lower die steel 15 through a front end tool portion. At the same time, the lower punch 23 is inserted into a guide bush/bushing 26. Furthermore, the gas tank 24 abuts the lower punch 23, at a front end of the gas tank 24 thereof, and against a rear end of the lower punch 23.

The lower punch 23 is arranged opposite to the upper punch 22 (i.e. as a mirror image), and can cut a panel while acting as a corresponding counterpart of the upper punch 20 at an opposite side to the upper punch 20 upon the forward movement of the upper punch 20 for the punching operation, i.e., supporting the upper punch 20 at an opposite side to the upper punch 20 with the panel interposed between the upper punch and the lower punch.

In addition, a stopper 25 is mounted on a bottom surface of the lower punch 23 so as to prevent an over-stroke upon a forward restoring operation of the lower punch 23.

The lower punch 23 is inserted into the guide bush/bushing 26 and is moved depending upon a stroke of the gas tank 24. The lower punch 23 serves to cut the panel and eject the scrap piece generated from the cutting of the panel. The gas tank 24 serves to support the lower punch 23 at the time of cutting the panel and upwardly push the lower punch 23 so as to allow the lower punch to cut the scrap piece.

Further, the lower die steel 15 serves to cut the panel along the variable trim line.

Here, the guide bush/busing, the gas tank and the stopper can be mounted so as to be supported by a die in which the lower die steel is positioned. The select retainer can also be mounted so as to be supported by a die in which the upper die steel is positioned.

The operation of the apparatus for machining a variable trim line of a panel of the present invention as constructed above will be described hereinafter.

Figure 7:
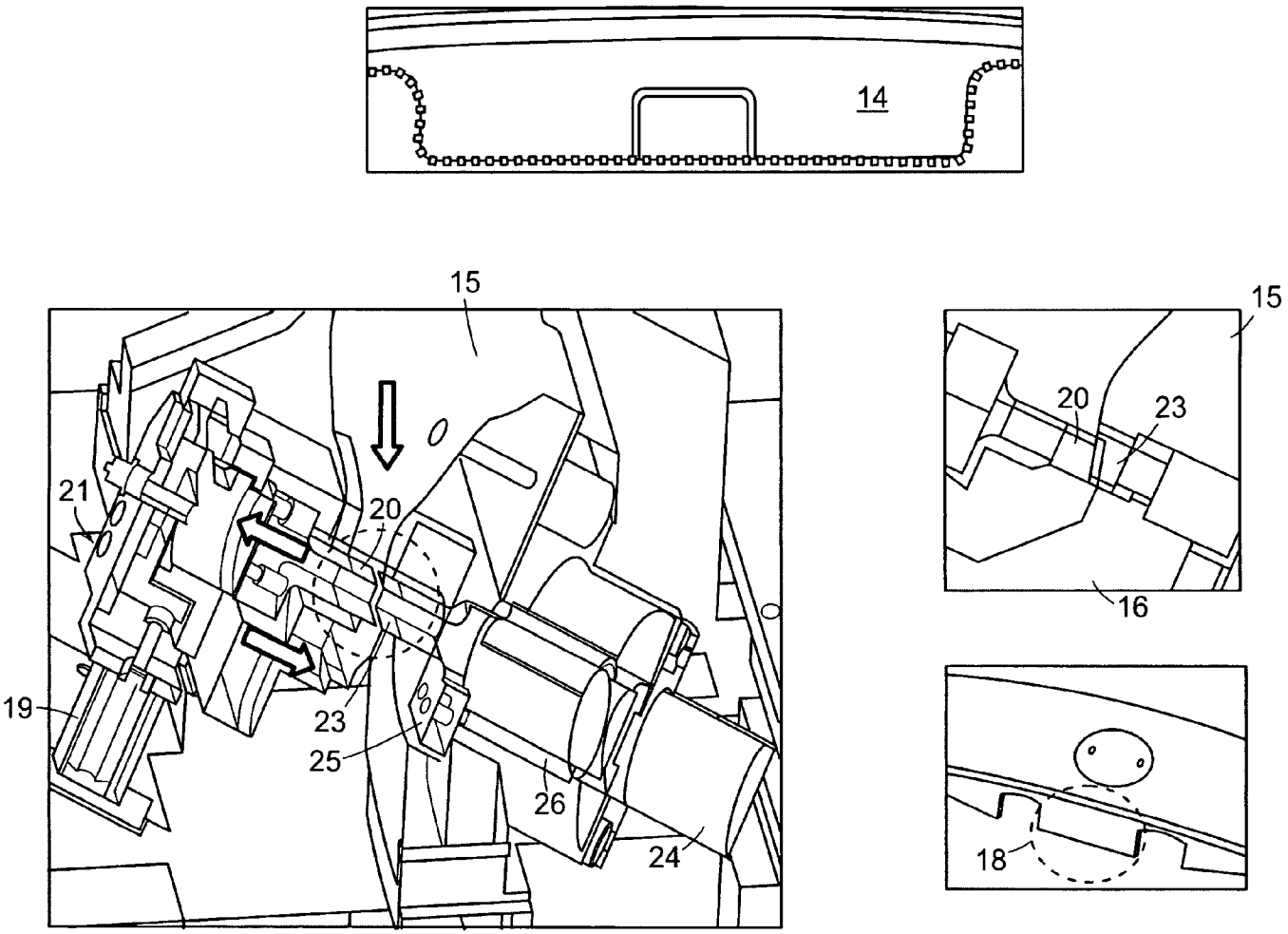
FIG. 7 is a schematic view showing the operation state of the upper die unit and the lower die unit at the time of machining a trunk lid panel on which a smart key is not mounted in the apparatus for machining the variable trim line of the panel according to an embodiment of the present invention.

FIG. 7 is a schematic view showing the operation state of the upper die unit and the lower die unit at the time of machining a trunk lid panel on which a smart key is not mounted in the apparatus for machining the variable trim line of the panel according to an embodiment of the present invention.

As shown in FIG. 7, an OP 20 process in which the trunk lid panel is not mounted with the PIC is shown.

In the case where the trunk lid panel is not mounted with the PIC, the variable trim line varies as shown by a dotted line in a panel positioned at an upper portion of the FIG. 7. In this case, the machining sequence of the trunk lid panel will be described hereinafter.

Once a panel is supplied, the select retainer 19 is operated to cause the upper punch 20 to be moved backward. Thus, the variable trim portion 18, i.e., a notch portion for the PIC is not machined.

In this state, when the upper die steel 16 is lowered so as to cause the upper punch to be fit into the lower die steel 15, the panel is trimmed.

At this time, the gas tank 24 supports the lower punch 23 so as to prevent the lower punch 23 from being pushed backward by a trimming force.

Since a gas tank force (e.g., 1500 kg) is larger than a shearing force (e.g., 620 kg), it prevents the trimming of the trunk lid panel.

Figure 8:
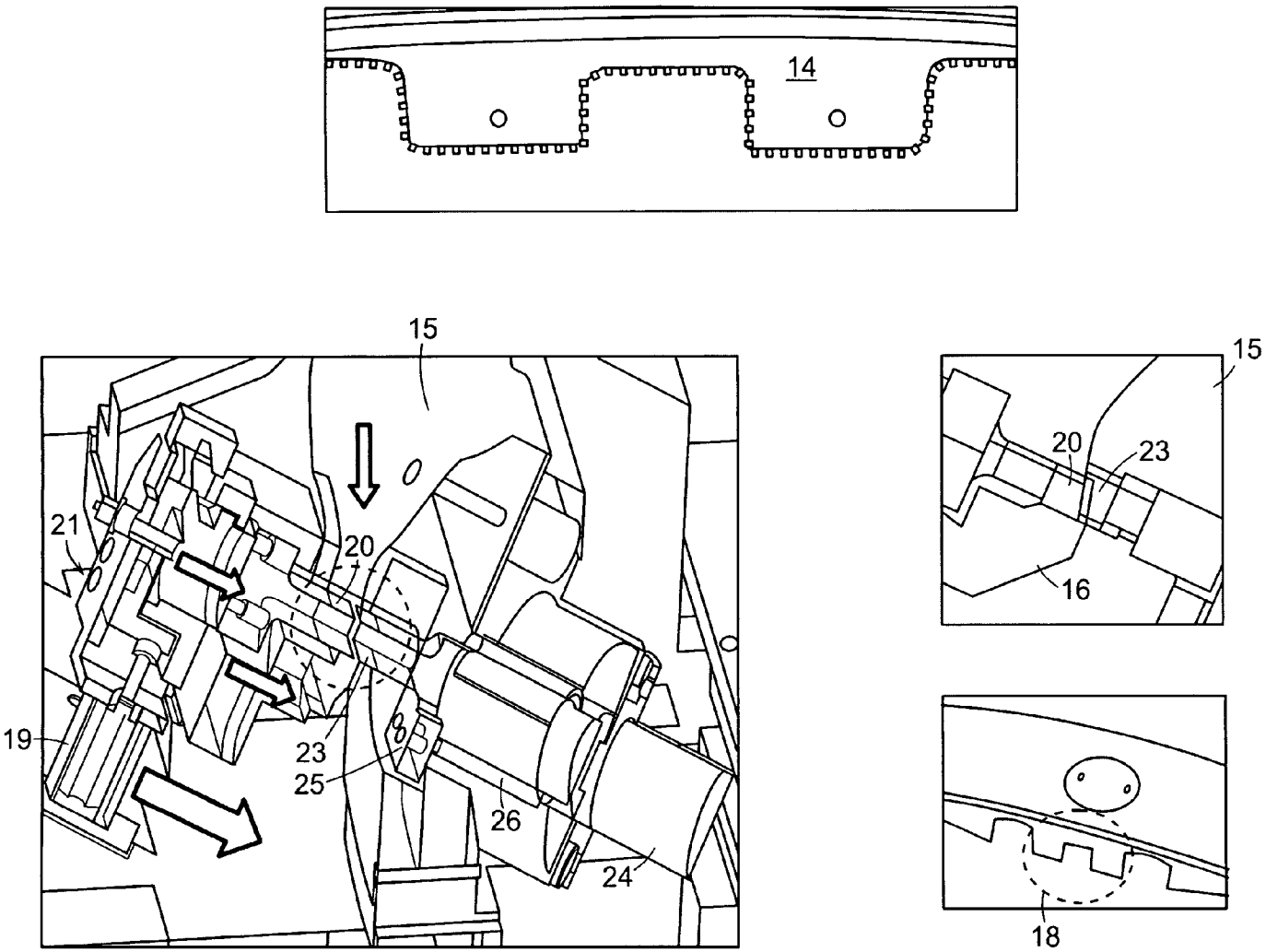
FIG. 8 is a schematic view showing the operation state of the upper die unit and the lower die unit at the time of machining a trunk lid panel on which a smart key is mounted in the apparatus for machining the variable trim line of the panel according to an embodiment of the present invention.

FIG. 8 is a schematic view showing the operation state of the upper die unit and the lower die unit at the time of machining a trunk lid panel on which a smart key is mounted in the apparatus for machining the variable trim line of the panel according to an embodiment of the present invention.

As shown in FIG. 8, there is shown an OP 30 process of a specification in which the trunk lid panel is mounted with the PIC.

In a case where the trunk lid panel is mounted with the PIC, the variable trim line varies as shown by a dotted line in a panel positioned at an upper portion of the FIG. 8. In this case, the machining sequence of the trunk lid panel will be described hereinafter.

Once a panel is supplied, the upper punch 20 mounted on the select retainer 19 of the upper die unit 21 is moved forward to a position where the upper punch 20 is fit into the lower die steel.

When the upper punch 20 is moved forward so as to be fit into the lower die steel 15, the notch portion for the PIC is machined accordingly.

In this case, the lower punch 23 is pushed backward by the upper punch 20 by a depth at which the upper punch 20 fits into the lower die steel.

When the upper punch 20 is moved backward, the backwardly pushed lower punch 23 returns to its original position while ejecting the scrap piece caught in the lower die steel 15. The lower punch 23 is returns to its original position by means of a forward restoring force of the gas tank.

Furthermore, any over-stroke of the lower punch 23 is controlled by the stopper 25.

Thus, it is possible to solve a problem of the conventional prior art. That is in the present invention, the scrap piece remaining at a PIC mounted portion is removed.

Furthermore, even in the case where a trim line of the panel varies depending on an assembly specification of a vehicle, it is possible to machine the variable trim line through a simple manipulation within the same process, thereby remarkably reducing costs for manufacturing dies.

As described above, the apparatus for machining a variable trim line of a panel according to the present invention advantageously reduces die manufacturing costs, increases panel production speed since the machining operation is performed through four processes which is less than existing five processes operations, and decreases the default rate that may occur during transportation.

Furthermore, it is possible to greatly reduce manufacturing costs for the existing five process-based productions at the time of transfer of the trunk lid panel to another manufacturing company for the next process.

The invention has been described in detain with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. An apparatus for cutting a trim line that is variable based on an assembly specification of a panel, the apparatus comprising:

a lower die steel which serves to cut the panel along the trim line;

an upper die steel which is lowered to be fit into the lower die steel to trim the panel;

an upper die unit attached to the upper die steel and including (i) a select retainer to selectively punch the trim line of the panel depending on whether or not a variable notch portion in the panel is required for a assembly specification, and (ii) an upper punch to be moved forward and backward by the select retainer;

a lower die unit a attached to the lower die steel so that in operation the lower die unit is movably operated in a direction opposite the upper die unit, the lower die unit including a lower punch that acts as a corresponding counterpart to the upper punch on the opposite side of the panel upon initiating a punching operation of the upper punch to cut the notch portion when the upper punch is moved forward at the same time; and a gas tank disposed behind the lower punch and configured to both (i) support the lower punch to prevent the lower punch from being pushed backward by a trimming force which occurs while a non-variable portion of the panel is being trimmed when the variable notch is not required in the trim line of the panel and (ii) be elastically movable so as to provide an ejecting force to the lower punch to eject a scrap piece caught in the lower die steel when the variable notch is required in the trim line of the panel.

2. The apparatus of claim 1, wherein the lower die unit further comprises:

a stopper to restrict a forward restoring position of the lower punch.

3. The apparatus of claim 1, wherein the lower die unit further comprises a guide bushing fit around an outer periphery of the lower punch and to precisely guide the forward and backward movement of the lower punch.

* * * * *